United States Patent [19]

Beatenbough

[11] Patent Number: 4,972,683

[45] Date of Patent: Nov. 27, 1990

[54] CONDENSER WITH RECEIVER/SUBCOOLER

[75] Inventor: Paul K. Beatenbough, Medina, N.Y.

[73] Assignee: Blackstone Corporation, Jamestown, N.Y.

[21] Appl. No.: 401,764

[22] Filed: Sep. 1, 1989

[51] Int. Cl.[5] ..... F25B 39/04

[52] U.S. Cl. ..... 62/507; 62/509; 165/110

[58] Field of Search ..... 62/506, 507, 509; 165/110

[56] References Cited

U.S. PATENT DOCUMENTS

| | | | |
|---|---|---|---|
| 247,578 | 9/1881 | Plumer | 62/506 X |
| 1,717,770 | 6/1929 | Grace | 165/110 |
| 2,004,390 | 6/1935 | Benzinger | 165/110 X |
| 2,611,587 | 9/1952 | Boling | 62/506 X |
| 2,649,698 | 8/1953 | Goldmann | 62/506 X |
| 3,051,450 | 8/1962 | White et al. | 165/110 |
| 3,096,630 | 7/1963 | Weller | 62/506 |
| 3,275,070 | 9/1966 | Beatenbough et al. | 165/111 |
| 4,688,311 | 8/1987 | Saperstein et al. | 29/157.3 R |

FOREIGN PATENT DOCUMENTS

| | | | |
|---|---|---|---|
| 0255313 | 2/1988 | European Pat. Off. | 62/506 |

*Primary Examiner*—William E. Tapolcai

*Attorney, Agent, or Firm*—Bean, Kauffman & Spencer

[57] ABSTRACT

An automotive condenser is disclosed as having vertically upstanding first and second headers communicating with inlet and outlet connections, respectively, and generally horizontally disposed tubes connected into such headers, wherein the second header is dimensioned to permit refrigerant gas to separate from refrigerant liquid to provide an upper volume of refrigerant gas and a lower volume of refrigerant liquid. The condenser may be provided with at least one horizontally extending subcooling tube placing the lower volume in flow communication with the outlet.

11 Claims, 1 Drawing Sheet

CONDENSER WITH RECEIVER/SUBCOOLER

BACKGROUND OF THE INVENTION

Automotive refrigeration systems of the type having a thermostatic expansion valve may benefit from having a receiver fitted into the system between its condenser and such valve to provide for storage of a volume of refrigerant sufficient to accommodate for variations in system operating conditions and loss of refrigerant due to diffusion and small leaks.

For a receiver to be effective, it must be arranged downstream of the point at which condensation of the refrigerant occurs, have an internal configuration including sufficient volume and/or internal centrifuge or baffling to permit separation of the gaseous and liquid phases of the refrigerant, have a liquid outlet arranged to communicate with liquid below the gas/liquid interface, and the refrigeration system be charged with a quantity of refrigerant such that the gas/liquid interface occurs within the volume enclosed by such receiver under applicable operating conditions.

Where an automotive refrigeration system is provided with a receiver and the refrigerant charge level of the system does not overfill the receiver under applicable operating conditions, a conventional condenser provides essentially zero refrigerant subcooling. In the event that overfilling of the receiver occurs, a conventional condenser may provide a level of subcooling that varies directly with the amount of refrigerant overfill and system operating conditions, but it is desirable to substantially avoid such subcooling in that it decreases the volume within the condenser available for condensing of refrigerant resulting in higher condenser pressures and lower system performance.

Automotive refrigeration systems operating with a receiver and a proper refrigerant charge level such as to maintain the gas/liquid interface within the volume enclosed by such receiver under applicable operating conditions may achieve higher performance levels with given system components by employing a separate subcooler arranged between the receiver and the thermostatic expansion valve. However, known systems employing subcoolers have the disadvantages of added cost, complexity, and a greater possibility of refrigerant leaks.

SUMMARY OF THE INVENTION

The present invention is directed towards a condenser particularly adapted for use in an automotive refrigeration system of the type having a thermostatic expansion valve.

The automotive condenser of the invention includes vertically upstanding first and second headers communicating with inlet and outlet connections and interconnected by generally horizontally disposed tubes, wherein the second header is dimensioned to permit refrigerant gas to separate from refrigerant liquid to provide an upper volume of refrigerant gas and a lower volume of refrigerant liquid disposed in flow communication with the outlet connection. When so configured and when used in a refrigeration system charged with a quantity of refrigerant such that the gas/liquid interface occurs within the volume enclosed by the second header, such second header avoids the necessity of providing an automotive refrigerant system of the type described with a separately formed receiver.

In an alternative form of the invention, a condenser of the type described is provided with at least one horizontally extending subcooler tube serving to place the lower volume in flow communication with the outlet connection. This construction avoids the necessity of providing an automotive refrigerant system with a separately formed subcooler, and will provide better overall system performance than will a conventional condenser having an identical frontal area available for heat transfer contact with a cooling medium.

BRIEF DESCRIPTION OF THE DRAWINGS

The nature and mode of operation of the present invention will now be more fully described in the following detailed description taken with the accompanying drawings wherein.

DETAILED DESCRIPTION

Figure 1:
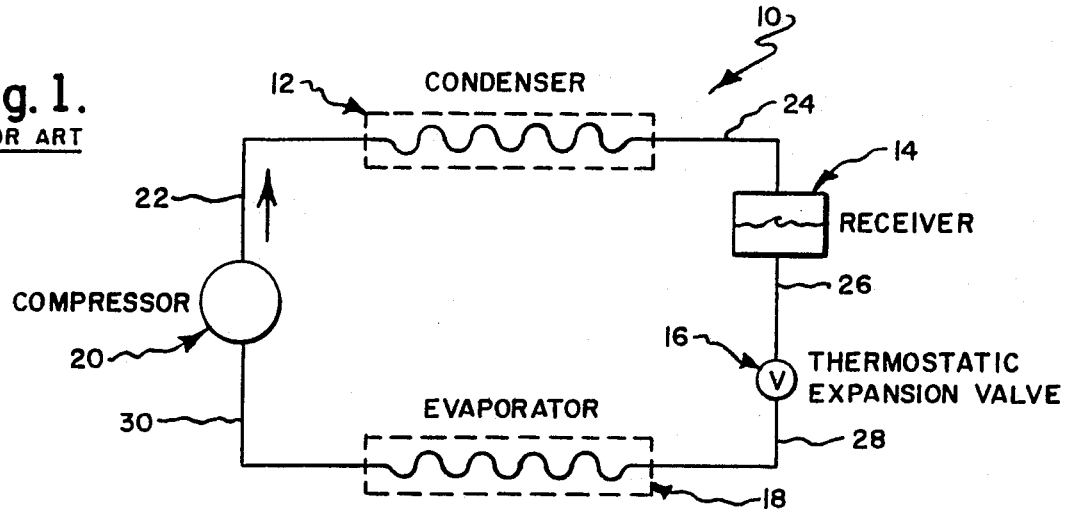
Fig. 1. PRIOR ART
FIG. 1 is a diagrammatic view of a conventional automotive refrigeration system.

Reference is first made to FIG. 1, wherein a conventional automotive refrigeration system is designated as 10 and shown as including a serially connected condenser 12; receiver 14; thermostatic expansion valve 16; evaporator 18; and compressor 20. Compressor 20 serves to circulate refrigerant through the system, whereby high pressure gaseous refrigerant is supplied by the compressor to condenser 12 via conduit 22; the condenser dissipates heat from the gaseous refrigerant and supplies receiver 14 with liquid or liquid/cool gaseous refrigerant via a conduit 24; the receiver defines a liquid/gas interface and supplies valve 16 with liquid refrigerant via a conduit 26; the valve reduces pressure of the liquid refrigerant and supplies a liquid/gas mixture at a lower pressure and lower temperature to evaporator 18 via a conduit 28; and the evaporator absorbs heat from a space/fluid to be cooled and supplies low temperature/pressure gaseous refrigerant to the compressor via a conduit 30. In a typical system, receiver 14 may include a removable cartridge, not shown, having a suitable filter and a desiccant for removing water from the refrigerant, and is provided with an internal configuration, e.g. volume and/or suitable liquid/gas separating device, such as a centrifugal or baffled separator, to ensure separation of liquid and gas phases of the refrigerant in order to provide a well defined liquid/gas interface. Receiver 14 also normally serves to prevent the backup of liquid refrigerant into condenser 12, which when of standard design would have its operation adversely affected, and to provide a reservoir of liquid refrigerant sufficient to accommodate for loss of refrigerant due to diffusion or small leaks.

Figure 2:
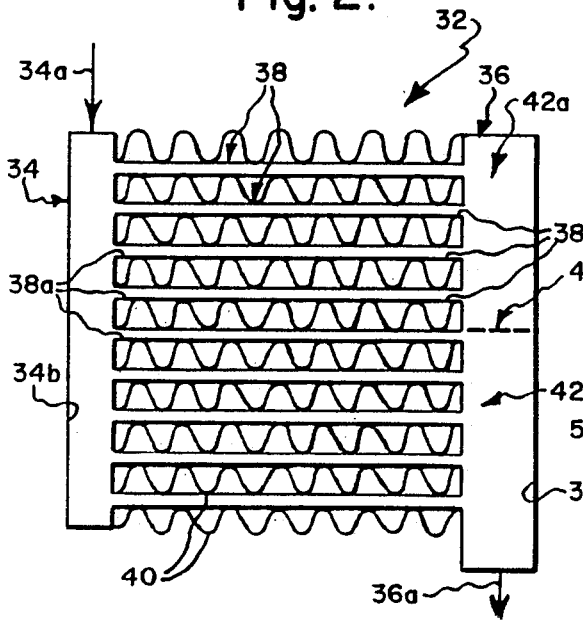
FIG. 2 is a view of a condenser of the present invention adapted for use in replacing the condenser and receiver shown in FIG. 1.

FIG. 2 illustrates an automotive condenser 32 formed in accordance with the present invention and adapted to be employed in place of condenser 12 and receiver 14 of the refrigeration system of FIG. 1. Condenser 32 is similar to condenser 12 from the standpoint that it includes generally upstanding first or inlet and second or outlet headers or tanks 34 and 36, into which are connected a refrigerant inlet 34a and a refrigerant outlet 36a, respectively; and a plurality of heat exchange tubes 38 for placing the interior chambers 34b and 36b of headers 34 and 36 in flow communication. Inlet 34a is intended to be connected to conduit 22, and outlet 36a intended to be connected to conduit 26.

Also, as is conventional, condenser 32 is provided with heat exchange fins 40 arranged in association with tubes 38 to assist in effecting heat transfer between the condenser and a coolant fluid, such as air, flowing normal to a frontal plane of the condenser, as viewed in FIG. 2, for purposes of cooling and condensing gaseous refrigerant introduced through inlet 34a. Headers 34 and 36 would normally extend vertically in an essentially parallel relationship, but may when required be inclined as much as 60° from the vertical.

First header 34 would, in accordance with known condenser design practice, be formed with a minimum internal cross-sectional area in order to maximize the burst strength of the header for a given side wall thickness of metal used in its fabrication, and typically would be no greater than that required by the size of its side wall openings into which the inlet ends 38a of tubes 38 are to be fitted.

Condenser 32 departs from known condenser design practice, wherein second header 36 would have a minimum internal cross-sectional area corresponding to that of first header 34, in that the second header is provided with an internal cross-sectional area, which is substantially larger than that required to accommodate the fitting thereinto of the outlet ends 38b of tubes 38. Specifically, the internal cross-sectional area of second header 36 is made sufficiently large to permit refrigerant gas to substantially separate from liquid refrigerant produced from refrigerant gas passing through tubes 38, whereby to define an upper volume 42a containing mostly gas and a lower volume 42b containing mostly liquid, which are divided by an interface 44. Interface 44 would normally not be horizontal or wholly continuous under driving conditions, due to vertical and horizontal acceleration forces to which condenser 32 would be continuously exposed. It is sufficient for the practice of the present invention that chamber 36b of second header 36 be internally sized to ensure that the velocity of fluid passing therethrough is reduced to a point at which the gas phase can separate from the liquid phase under the influence of gravity and not be swept along with the liquid phase exiting through outlet 36a, whereby to achieve and maintain substantial separation between the gas and liquid phases of the refrigerant within the second header during normal use conditions, and that outlet 36a be connected into a lowermost region of volume 42b. Flow of refrigerant through tubes 38 below interface 44 is not adversely affected.

Present automotive condensers may have heat transfer tubes whose transverse dimensions are as small as about 0.25 inch, thus dictating that the internal cross-section area of their associated first and second headers be somewhat larger than 0.05 square inches. The largest such internal cross-section area known in prior art is somewhat less than 1.0 square inches. By comparison, it is contemplated, for example, that the internal cross-sectional area of second header 36 of condenser 32 be greater than about 1.25 square inches. Moreover, it is contemplated that second header 36 would have a vertical dimension of greater than 7 inches for refrigerant systems having maximum refrigerant flow rates of 5 pounds per minute or greater.

It is preferable to arrange all of tubes 38 in parallel in order to maximize the available vertical dimension of the applicable receiver volume within second header 36. Multi-passing tubes 38 would subdivide this volume and only the lowermost subdivision is effective for purposes of gas/liquid separation. However, if vertical space available for condenser installation allows, it is permissive to convert condenser 32 into a multi-pass condenser by arranging one or more additional heat exchange tubes, not shown, in series between inlet 34a and the parallel tubes 38. The design of tubes 38 may be conventional, but in any event is not limiting on the practice of the present invention.

It is critical to the practice of the present invention that the refrigerant charge to the system 10 be selected such that during normal operating conditions for which the system is designed, lower volume 42b consisting mostly of liquid refrigerant be constantly maintained within second header 36.

Figure 3:
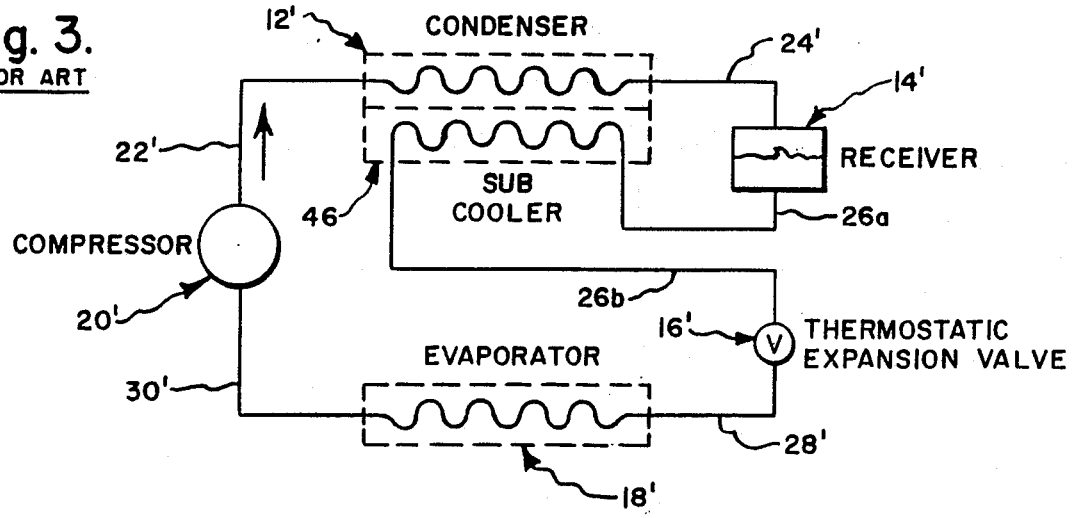
Fig. 3. PRIOR ART
FIG. 3 is a diagrammatic view of a conventional automotive refrigeration system employing a separate subcooler.

FIG. 3 illustrates a conventional automotive refrigeration system 10', wherein elements similar to those of system 10, are designated by like primed numerals. System 10' differs from system 10 in the provision of a subcooler 46 having an inlet and outlet connected to receiver 14' and valve 16' by conduits 26a and 26b. Subcooler 46 is normally formed separately from condenser 12', but may be arranged adjacent thereto as depicted in FIG. 3.

Automotive refrigeration systems employing subcooler 46 can achieve higher performance levels with a given condenser 12, 12', evaporator 18, 18' and compressor 20, 20' than do systems without such subcooler, even if the cooling fluid used to achieve subcooling is subsequently passed through the condenser, or the cooling fluid is passed through the subcooler after having passed through the condenser.

Figure 4:
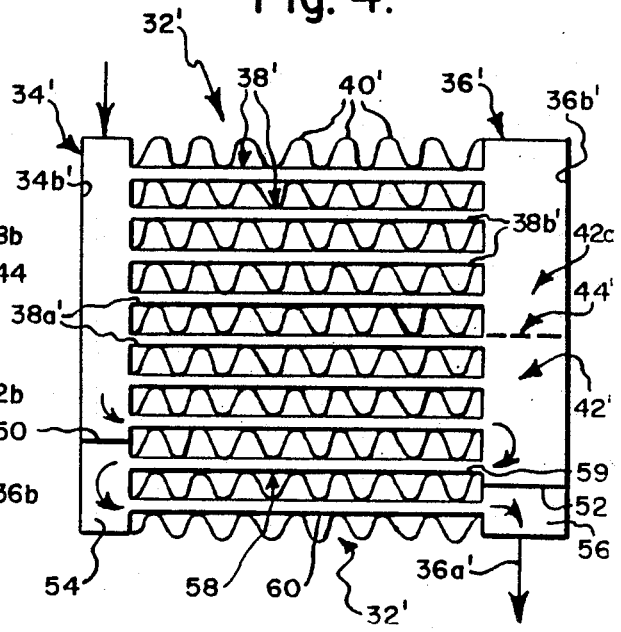
FIG. 4 is a view of a condenser of a further embodiment of the present invention adapted for use in replacing the condenser, receiver and subcooler of FIG. 3.

FIG. 4 illustrates an automotive condenser 32' formed in accordance with a second embodiment of the present invention, wherein elements similar to elements of condenser 32 are designated by like primed numerals. The illustrated form of condenser 32' differs from condenser 32 in that first and second headers 34' and 36' are provided with transverse first and second partitions 50 and 52 to define first and second lower chambers 54 and 56, which are arranged below chambers 34b and 36b, respectively; a first subcooling tube 58 is arranged below the lowermost one of tubes 38' with its opposite ends in flow communication with lower volume 42b' via liquid outlet means, such as for example may be defined by a second header discharge opening 59, and the first lower chamber; a second subcooling tube 60 is arranged below the first subcooling tube with its opposite ends in flow communication with the first and second lower chambers; and outlet 36a' is connected into the second lower chamber for flow communication with lower volume 42b' via the second subcooling tube, the first lower chamber and the first subcooling tube.

In the presently preferred construction, tubes 38' are connected in parallel with subcooling tubes 58 and 60 being arranged in series.

Condenser 32' may be modified, if desired, as by providing only subcooling tube 58, in which case outlet 36a' may be connected into lower chamber 54, or by providing one or more additional lower chambers serially communicating with one or more additional subcooling tubes. However, it is preferable that in any event, tubes 38' occupy at least 80% of the frontal flow area of condenser 32', as viewed in FIG. 4. A higher performance level can be achieved with condenser 32', as compared to condenser 32, even for the case where these condensers occupy the same frontal area.

What is claimed is:

1. A refrigeration condenser comprising in combination:

first and second generally vertically upstanding headers;

a plurality of generally horizontally disposed condenser tubes, at least certain of said tubes having inlet ends connected into said first header and outlet ends connected into said second header and forming parallel refrigerant gas conducting flow paths connecting said first and second headers;

a refrigerant gas inlet communicating with said inlet ends and a refrigerant liquid outlet communicating with a lower portion of said second header; said second header being dimensioned of sufficiently large internal cross-sectional area such that when said condenser is charged with sufficient refrigerant to maintain a liquid to gas interface above said refrigerant liquid outlet refrigerant gas is permitted to substantially separate from refrigerant liquid produced from said refrigerant gas passing through said tubes to produce an upper volume of refrigerant gas and a sufficient lower volume of refrigerant liquid within said second header and the velocity of refrigerant liquid flowing towards said refrigerant liquid outlet is not sufficient to sweep refrigerant gas entering said lower volume from the lowermost of said flow paths, flowing under the influence of gravity from the lower volume to the upper volume, through said refrigerant liquid outlet.

2. A condenser according to claim 1, wherein said refrigerant liquid outlet communicates with said lower volume via at least one subcooling tube extending essentially parallel to said certain tubes.

3. A condenser according to claim 1, wherein at least one subcooling tube is disposed essentially parallel to said certain tubes, said first header is divided to define relatively upper and lower chambers, said upper chamber communicates with said inlet ends, said one subcooling tube communicates with said lower volume and said lower chamber, and said refrigerant liquid outlet communicates with said lower volume via said lower chamber and said one subcooling tube.

4. A condenser according to claim 3, wherein said second header is divided to define a relatively upper chamber bounding said upper and lower volumes and a lower chamber connected to said lower chamber of said first header by a second subcooling tube, and said refrigerant liquid outlet communicates with said second chamber of said second header.

5. A refrigeration condenser comprising in combination:

first and second generally vertically upstanding headers defining first and second chambers, respectively, at least one of said headers defining an additional lower chamber;

an inlet for supplying refrigerant gas to said first chamber of said first header, said second chamber having liquid outlet means, and said additional lower chamber having a refrigerant liquid outlet;

a plurality of condenser tubes, at least certain of which have inlet ends connected into said first chamber and outlet ends connected into said second chamber and forming parallel refrigerant gas conducting flow paths connecting said first and second chambers, said liquid outlet means being disposed below a lowermost of said flow paths, said second chamber of said second header being dimensioned of sufficiently large internal cross-sectional area such that when charged with sufficient refrigerant to maintain a liquid to gas interface above said liquid outlet means refrigerant gas is permitted to substantially separate from refrigerant liquid produced from said refrigerant gas passing through said tubes to produce an upper volume of refrigerant gas and a sufficient lower volume of refrigerant liquid within said second chamber and the velocity of refrigerant liquid flowing towards said liquid outlet means is not sufficient to sweep refrigerant gas entering said lower volume from the lowermost of said flow paths, flowing under the influence of gravity from the lower volume to the upper volume, through said liquid outlet means; and a subcooling tube connecting said liquid outlet means in flow communication with said additional lower chamber.

6. A condenser according to claim 5, wherein said additional lower chamber is defined by said first header.

7. A condenser according to claim 6, wherein a second lower chamber is defined by said second header, and said refrigerant liquid outlet communicates with said additional lower chamber via a flow connection to said second lower chamber and a second subcooling tube extending between said second lower chamber and said additional lower chamber.

8. In an automotive refrigeration system of the type having a refrigeration condenser, an expansion valve, an evaporator and a compressor arranged in series flow connection, the improvement comprising:

said condenser includes first and second generally vertically upstanding headers, a plurality of generally horizontally disposed condenser tubes having inlet ends connected into said first header and outlet ends connected into said second header and forming parallel refrigerant gas conducting flow paths connecting said first and second chambers, an inlet means communicating with said inlet ends for passing thereto refrigerant gas from said compressor, a refrigerant liquid outlet means communicating with a lower portion of said second header for passing refrigerant liquid from said second header to said valve, said second header being dimensioned of sufficiently large cross-sectional area such that when charged with sufficient refrigerant to maintain a liquid to gas interface above said refrigerant outlet means, refrigerant gas is permitted to substantially separate from refrigerant liquid produced from said refrigerant gas passing through said tubes to produce an upper volume of refrigerant gas and a sufficient lower volume of refrigerant liquid within said second header separated by a liquid to gas interface and the velocity of refrigerant liquid flowing toward said liquid outlet means is not sufficient to sweep refrigerant gas, flowing under the influence of gravity from the lower volume to the upper volume, through said refrigerant liquid outlet means; and said system is charged with refrigerant sufficient under normal operating conditions of said system to maintain said interface above said refrigerant outlet means.

9. The improvement according to claim 8, wherein said outlet means communicates with said lower volume via at least one subcooling tube extending essentially parallel to said tubes.

10. The improvement according to claim 8, wherein at least one subcooling tube is disposed essentially parallel to said tubes, said first header is divided to define relatively upper and lower chambers, said upper chamber communicates with said inlet ends, said one subcooling tube communicates with said lower volume and said lower chamber, and said outlet means communicates with said lower volume via said lower chamber and said one subcooling tube.

11. The improvement according to claim 10, wherein said second header is divided to define a relatively upper chamber bounding said upper and lower volumes and a lower chamber connected to said lower chamber of said first header by a second subcooling tube, and said outlet means communicates with said second chamber of said second header.

* * * * *